US010376078B2

(12) United States Patent
Johnson

(10) Patent No.: US 10,376,078 B2
(45) Date of Patent: Aug. 13, 2019

(54) PICTURE STAND SYSTEM

(71) Applicant: Susan Johnson, Tinton Falls, NJ (US)

(72) Inventor: Susan Johnson, Tinton Falls, NJ (US)

( * ) Notice: Subject to any disclaimer, the term of this patent is extended or adjusted under 35 U.S.C. 154(b) by 86 days.

(21) Appl. No.: 15/616,431

(22) Filed: Jun. 7, 2017

(65) Prior Publication Data

US 2018/0352977 A1 Dec. 13, 2018

(51) Int. Cl.
*A47F 1/14* (2006.01)
*A47G 1/14* (2006.01)

(52) U.S. Cl.
CPC ..... *A47G 1/143* (2013.01); *A47G 1/142* (2013.01)

(58) Field of Classification Search
CPC ..... A47G 1/142; A47G 1/143; A47G 1/166
USPC ..... 248/469, 457, 473; 40/761, 750, 754, 40/779, 796
See application file for complete search history.

(56) References Cited

U.S. PATENT DOCUMENTS

| | | | | |
|---|---|---|---|---|
| 2,115,448 | A | 4/1938 | Pradt | |
| 2,523,815 | A * | 9/1950 | Cloyd | A47G 1/10 40/790 |
| 4,216,936 | A | 8/1980 | DeSelms | |
| 4,655,428 | A | 4/1987 | McCrea | |
| 5,570,526 | A * | 11/1996 | Wallon | A47G 1/143 248/455 |
| 5,836,565 | A | 11/1998 | Chang | |
| 6,282,827 | B1 | 9/2001 | Holmes | |
| 6,527,242 | B1 | 3/2003 | Kennedy | |
| 7,284,739 | B2 * | 10/2007 | Yasuki | A47G 1/143 248/457 |
| 2013/0097907 | A1 * | 4/2013 | Krohn | A47G 1/143 40/761 |

* cited by examiner

*Primary Examiner* — Todd M Epps

(57) ABSTRACT

A picture stand system for coupling a stand to a picture frame includes a picture frame. A stand is provided and the stand is selectively coupled to said picture frame. Moreover, the stand is configured to props the picture frame up on a support surface thereby facilitating the picture frame to be displayed. An adhesive layer is coupled to said stand. The adhesive layer adhesively engages the picture frame to retain the stand on the picture frame.

3 Claims, 4 Drawing Sheets

PICTURE STAND SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to stand devices and more particularly pertains to a new stand device for coupling a stand to a picture frame.

BRIEF SUMMARY OF THE INVENTION

An embodiment of the disclosure meets the needs presented above by generally comprising a picture frame. A stand is provided and the stand is selectively coupled to said picture frame. Moreover, the stand is configured to props the picture frame up on a support surface thereby facilitating the picture frame to be displayed. An adhesive layer is coupled to said stand. The adhesive layer adhesively engages the picture frame to retain the stand on the picture frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
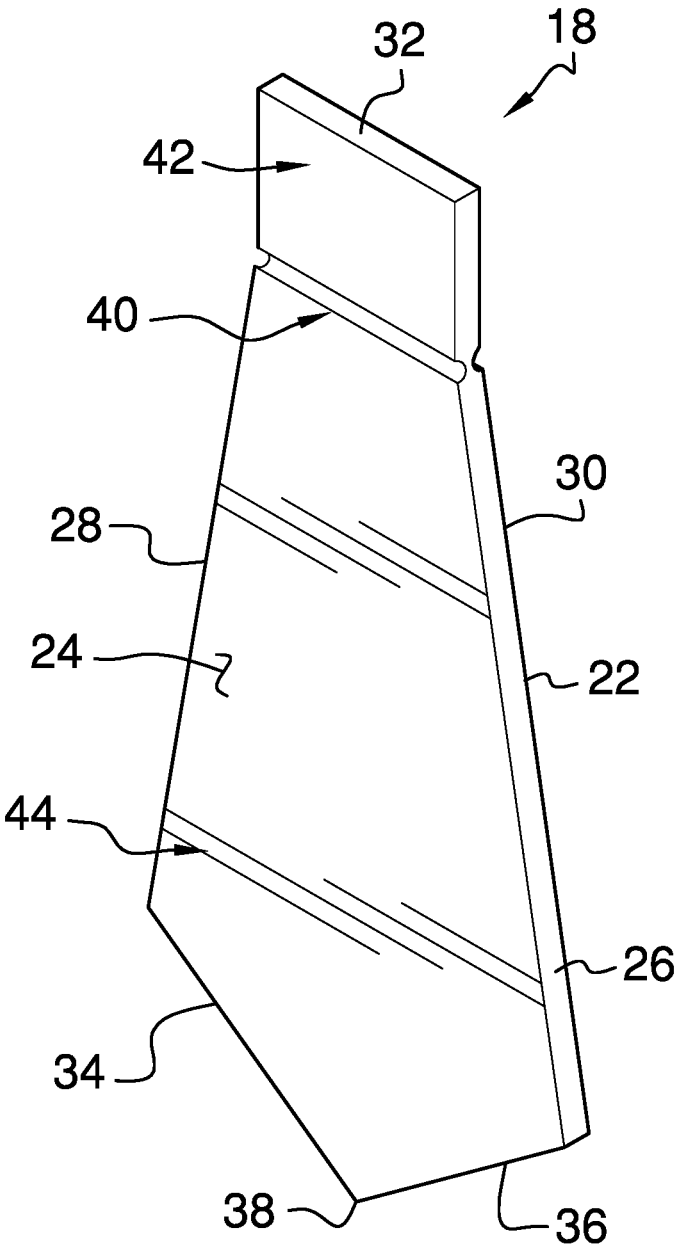
FIG. 1 is a front perspective view of stand of a picture stand system according to an embodiment of the disclosure.
Figure 2:
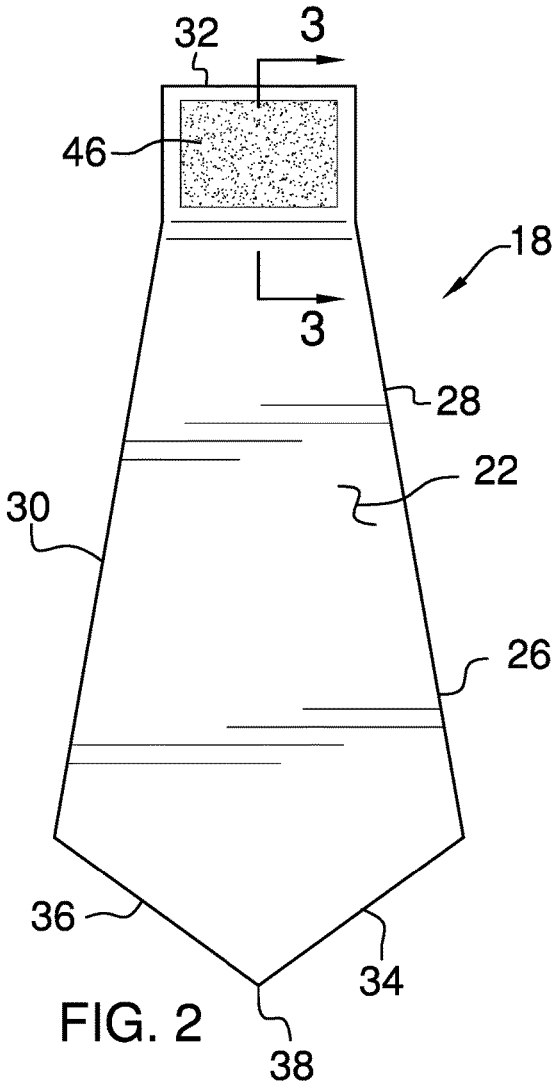
FIG. 2 is a back view of a stand of an embodiment of the disclosure.
Figure 3:
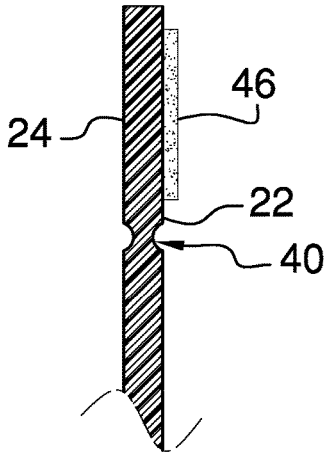
FIG. 3 is a cross sectional view taken along line 3-3 of FIG. 2 of an embodiment of the disclosure.
Figure 4:
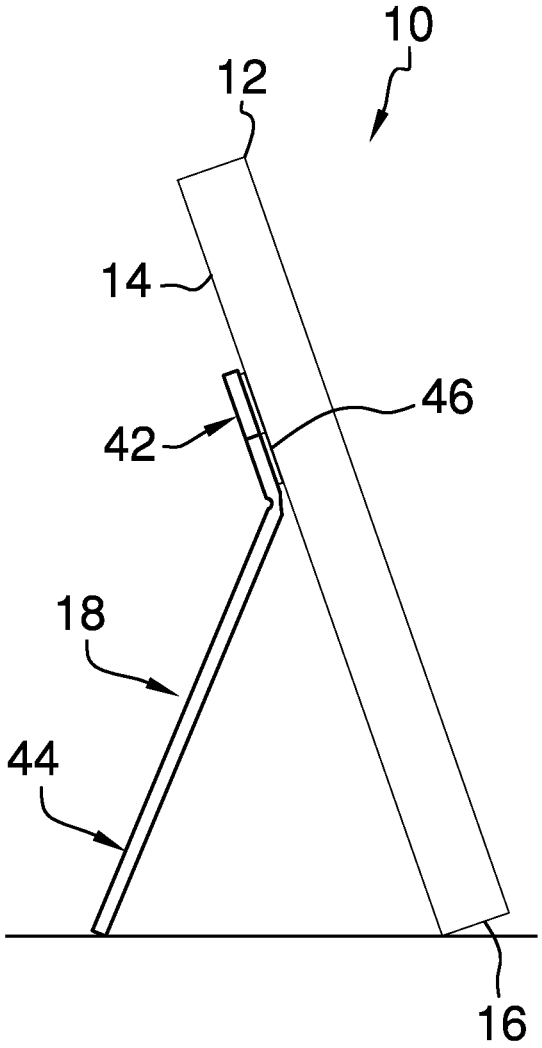
FIG. 4 is a perspective in-use view of an embodiment of the disclosure.
Figure 5:
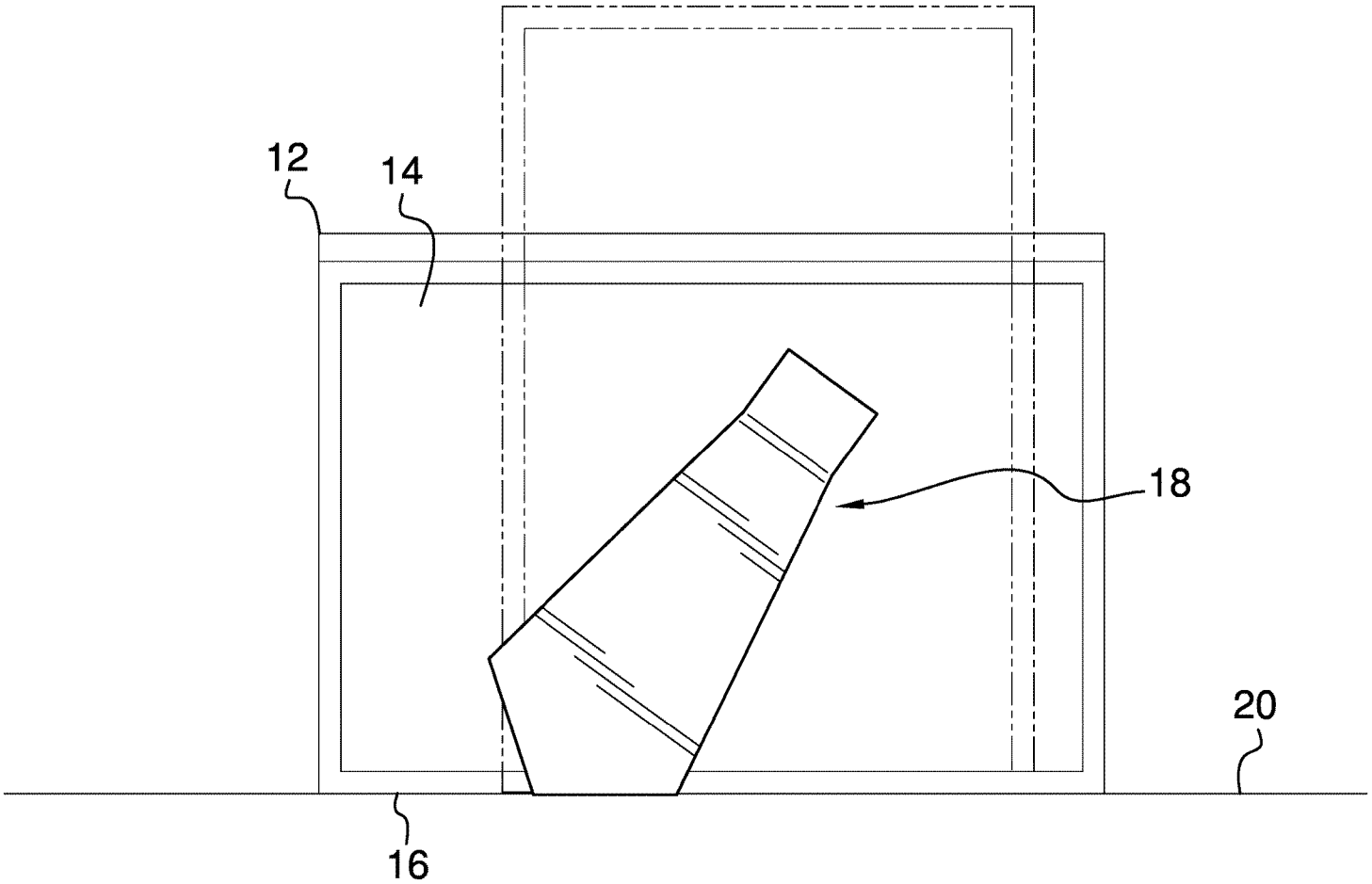
FIG. 5 is a rear perspective in-use view of an embodiment of the disclosure.

With reference now to the drawings, and in particular to FIGS. 1 through 5 thereof, a new stand device embodying the principles and concepts of an embodiment of the disclosure and generally designated by the reference numeral 10 will be described.

As best illustrated in FIGS. 1 through 5, the picture stand system 10 generally comprises a picture frame 12 that has a back side 14 and a bottom edge 16. The picture frame 12 may be a picture frame 12 of any conventional design the does not have an integrated stand 18. A stand 18 is provided and the stand 18 is selectively coupled to the picture frame 12. The stand 18 props the picture frame 12 up on a support surface 20 thereby facilitating the picture frame 12 to be displayed.

The stand 18 has a first surface 22, a second surface 24 and a peripheral edge 26 extending therebetween. The peripheral edge 26 has a first lateral side 28, a second lateral side 30, a top side 32, a first sloped side 34 and a second sloped side 36. Each of the first 34 and second 36 sloped sides intersects each other to form a point 38. Each of the first 28 and second 30 lateral sides angles outwardly between the top side 32 and an associated one of the first 34 and second 36 sloped sides.

The stand 18 has a joint 40 extending between the first 28 and second 30 lateral sides to define a first half 42 and a second half 44 of the stand 18. The stand 18 is selectively bent along the joint 40 such that the first half 42 forms an angle with the second half 44. The joint 40 is positioned closer to the top side 32 than the point 38. The joint 40 may be formed via a pair of depressions each extending inwardly on an associated one of the first 22 and second 24 surfaces of the stand 18.

An adhesive layer 46 is provided and the adhesive layer 46 is coupled to the stand 18. The adhesive layer 46 adhesively engages the picture frame 12 to retain the stand 18 on the picture frame 12. The adhesive layer 46 is coupled to the first surface 22 corresponding to the first half 42 and the adhesive layer 46 adheres to the back side 14 of the picture frame 12. Moreover, the stand 18 is positioned at an angle on the back side 14. In this way a selected one of the first 34 and second 36 slopes sides is positioned to abut the support surface 20.

In use, the stand 18 is positioned on the back side 14 of the picture frame 12 such that the adhesive layer 46 engages the back side 14. In this way the stand 18 is retained on the picture frame 12. The stand 18 is positioned on the picture frame 12 to facilitate the picture frame 12 to be selectively oriented in a landscape position and a portrait position. Moreover, a selected one of the first 34 and second 36 sloped sides is aligned with the bottom edge 16 of the picture frame 12. The second half 44 of the stand 18 is urged to angle away from the back side 14 of the picture frame 12 and the selected first 34 and second 36 sloped sides abuts the support surface 20. In this way the picture frame 12 is propped on the support surface 20 for displaying the picture frame 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A picture stand system comprising:

a picture frame having a back side and a bottom edge; and a stand being selectively coupled to said picture frame wherein said stand is configured to prop said picture frame up on a support surface thereby facilitating said picture frame to be displayed, said stand comprising a first surface, a second surface and a peripheral edge extending therebetween, said peripheral edge having a first lateral side, a second lateral side, a top side, a first sloped side and a second sloped side, each of said first and second sloped sides intersecting each other to form a point, each of said first and second lateral sides angling outwardly between said top side and an associated one of said first and second sloped sides, and a joint extending between said first and second lateral sides to define a first half and a second half of said stand, said stand being selectively bent along said joint such that said first half forms an angle with said second half, said joint being positioned closer to said top edge than said point, said joint being defined by a pair of recesses extending across said stand, said recesses being coplanar, parallel and aligned through said stand, each recess having a semi-circular shape perpendicular to a longitudinal axis of said recess; and an adhesive layer being coupled to said stand, said adhesive layer being adhesively engaged to said picture frame to retain said stand on said picture frame.

2. The assembly according to claim 1, wherein:

said adhesive layer is coupled to said first surface corresponding to said first half, said adhesive layer adhering to said back side of said picture frame, said stand being positioned at an angle on said back side wherein a selected one of said first and second slopes sides is configured to abut the support surface.

3. A picture stand system comprising:

a picture frame having a back side and a bottom edge; and a stand being selectively coupled to said picture frame wherein said stand is configured to prop said picture frame up on a support surface thereby facilitating said picture frame to be displayed, said stand comprising a first surface, a second surface and a peripheral edge extending therebetween, said peripheral edge having a first lateral side, a second lateral side, a top side, a first sloped side and a second sloped side, each of said first and second sloped sides intersecting each other to form a point, each of said first and second lateral sides angling outwardly between said top side and an associated one of said first and second sloped sides, and a joint extending between said first and second lateral sides to define a first half and a second half of said stand, said stand being selectively bent along said joint such that said first half forms an angle with said second half, said joint being positioned closer to said top edge than said point, said joint being defined by a pair of recesses extending across said stand, said recesses being coplanar, parallel and aligned through said stand, each recess having a semi-circular shape perpendicular to a longitudinal axis of said recess; and an adhesive layer being coupled to said stand, said adhesive layer being adhesively engaged to said picture frame to retain said stand on said picture frame, said adhesive layer being coupled to said first surface corresponding to said first half, said adhesive layer adhering to said back side of said picture frame, said stand being positioned at an angle on said back side wherein a selected one of said first and second slopes sides is configured to abut the support surface.

* * * * *